United States Patent [19]

Sundin

[11] 3,990,351

[45] Nov. 9, 1976

[54] PNEUMATIC IMPACT DEVICE

[75] Inventor: Bertil Waldemar Sundin, Enskede, Sweden

[73] Assignee: Atlas Copco Aktiebolag, Nacka, Sweden

[22] Filed: Dec. 5, 1974

[21] Appl. No.: 529,908

Related U.S. Application Data

[62] Division of Ser. No. 336,369, Feb. 27, 1973, abandoned.

[30] Foreign Application Priority Data

Mar. 10, 1972 Sweden ..... 3038/72

[52] U.S. Cl. ..... 91/402; 83/580; 83/617; 83/639; 91/5; 91/394; 91/410; 91/471; 92/85 B; 92/129

[51] Int. Cl.[2] ..... F15B 15/22

[58] Field of Search ..... 91/394, 402, 357, 408, 91/409, 5, 392, 471, 24, 25, 232, 321, 325, 422, 410; 92/85, 143, 8, 10, 62, 65, 6 R, 6 D, 129; 83/639, 617, 580

[56] References Cited

UNITED STATES PATENTS

| | | | |
|---|---|---|---|
| 242,995 | 6/1881 | Shortt | 92/248 |
| 675,880 | 6/1901 | Carlisle | 91/392 X |
| 1,595,939 | 8/1926 | Hukill | 91/321 |
| 3,028,840 | 4/1962 | Leavell | 91/325 X |
| 3,105,414 | 10/1963 | Cvjetkovic | 91/392 X |
| 3,264,942 | 8/1966 | Witt | 92/85 X |
| 3,312,146 | 4/1967 | Quéré | 92/62 |
| 3,338,136 | 8/1967 | Jerome | 92/249 |
| 3,352,143 | 11/1967 | Bollar | 91/5 X |
| 3,363,513 | 1/1968 | Ottestad | 91/5 |
| 3,402,592 | 9/1968 | Machon | 92/113 X |
| 3,631,760 | 1/1972 | Moran | 91/402 |
| 3,739,863 | 6/1973 | Wohlwend | 91/321 X |

*Primary Examiner*—Martin P. Schwadron
*Assistant Examiner*—Abraham Hershkovitz
*Attorney, Agent, or Firm*—Flynn & Frishauf

[57] ABSTRACT

A pneumatic impact device comprising a housing, a drive piston and a piston rod. At the forward end of the piston rod there is attached a tool intended for metal working like punching, cropping or forging. The housing contains a drive chamber, an air charge chamber, a reverse chamber and a retard chamber. The piston rod is provided with two forward-facing, annular shoulders one of which constitutes a reverse piston for working in the reverse chamber and the other a retard piston for working in the retard chamber. For being protected from impact strains, the drive piston is longitudinally displaceable relative to the piston rod. During the working strokes, the drive piston cooperates with a backwardly facing shoulder on the piston rod, but just before the latter reaches the point where the tool hits the billet to be worked, the drive piston is stopped in the drive chamber and is thereby separated from the piston rod shoulder.

14 Claims, 3 Drawing Figures

PNEUMATIC IMPACT DEVICE

This is a Divisional Application of U.S. Ser. No. 336,369, filed Feb. 27, 1973, now abandoned.

This invention relates to a pneumatic impact device intended for metal working like punching, cropping and forging. Particularly, the invention refers to a device comprising a cylinder housing, wherein a drive piston and a piston rod are reciprocably guided. The drive piston and the piston rod are longitudinally displaceable relative to each other and the drive piston is arranged to drive the piston rod during the working stroke by cooperation with a backwardly facing shoulder on the latter.

An impact device of this type is disclosed in Swedish patent 159,289. (Corresponding to British Pat. No. 717,518, and to Canadian Pat. No. 584,416.)

In impact devices of this type, it is desirable to enlarge the drive piston area in order to increase the driving force and the acceleration. A faster acceleration would in turn make it possible to shorten the working stroke length which would be advantageous in that a simpler tool having shorter guide surfaces could be used. This is not possible at the impact device according to the above mentioned patent, because the drive piston thereof is intended not only to drive the piston rod during the return stroke but to transfer kinetic energy from the piston rod to the cylinder housing at no-load strokes. If that piston were made wider it would be exposed to unsustainable strains.

Moreover, it is desirable to decrease the weight of the parts which are accelerated during the working stroke because that too will cause a faster acceleration and a shorter stroke.

It is the object of the invention to make an impact device which has a large drive piston area and a low total weight of the reciprocating parts and in which the drive piston or any other part is exposed to unpermittably high strains.

This is accomplished by the device which is defined by the claims.

BRIEF DESCRIPTION OF THE DRAWINGS

An embodiment of the invention will hereinafter be described in detail with references to the drawings in which

FIG. 1 shows the impact device in its start position before the working stroke.

FIG. 2 shows the impact device during the working stroke just before the tool hits the billet to be worked and FIG. 3 shows the impact device in a position in which the tool has performed the intended work and the return stroke is initiated.

DETAILED DESCRIPTION OF ILLUSTRATED EMBODIMENT

Figure 3:
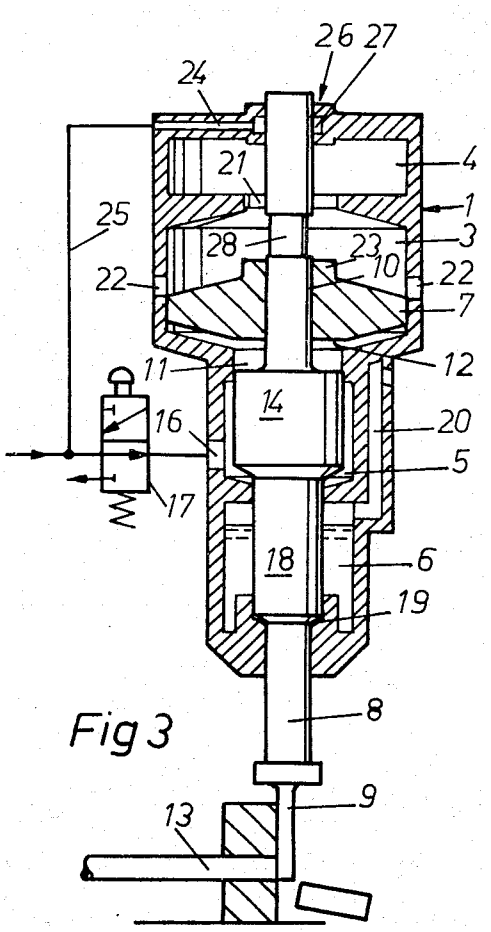
FIGS. 1–3 show an impact device according to the invention provided with a tool intended for high velocity cropping.
Figure 2:
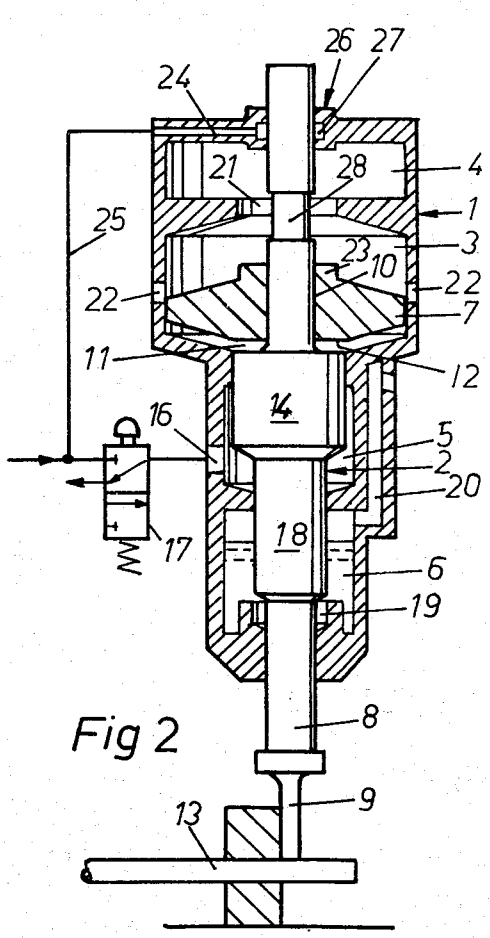

The impact device shown in the drawing comprises a cylinder housing 1 and a piston unit 2 which is reciprocably guided in said housing. The cylinder housing 1 comprises a drive chamber 3, a charge chamber 4, a reverse chamber 5 and a retard chamber 6 the latter of which is intended for absorbing of kinetic energy from the piston unit 2 at the end of the working strokes.

The piston unit 2 consists of a drive piston 7, a piston rod 8 and a working tool 9. The tool 9 is rigidly attached to the forward end of the piston rod 8. The piston rod and the drive piston 7 are arranged to be longitudinally displaceable relative to each other. For that purpose the drive piston 7 is provided with a centrally located opening 10 through which the piston rod extends. For transferring a driving force to the piston rod, the drive piston 7 has a driving surface 12 for cooperation with a backwardly facing shoulder 11 on the piston rod. As the drive piston 7 is driven forwards by pressure air, the driving surface 12 gets into engagement with the shoulder 11 and drives the piston rod 8 and the tool 9 forwards toward a billet 13 which is going to be worked. By the driving surface-shoulder arrangement, the piston rod 8 is freely displaceable relative to the drive piston. (The tool 9 and the cooperating stationary billet support are just shown schematically on the drawing.)

A wider portion of the piston rod 8 extends forwardly from the shoulder 11 into the reverse chamber 5. Within the reverse chamber, a reverse piston 14 is constituted by a diameter reduction of the piston rod 8. In other words, the active area of the reverse piston 14 is a forward facing, annular shoulder. The object of the reverse piston 14 is to bias the piston unit 2 toward its rear end position by action of pressure air in the reverse chamber 5.

To the reverse chamber 5, there is connected a spring biased valve 17 by which the former can be connected to a pressure air source (not shown) and the atmosphere alternatively. In the rest position of the valve 17, (as in FIG. 1) the reverse chamber 5 is connected to the pressure air source.

From the shoulder which constitutes the reverse piston 14, the piston rod 8 extends forwardly through the retard chamber 6. In this chamber too the piston rod diameter is reduced for establishing an annular retard piston 18.

At its forward end, the retard chamber 6 is provided with a cylindrical, cup-shaped portion 19 the diameter of which exceeds that of the retard piston 18 in such a way that a narrow clearance is left therebetween as the retard piston enters this portion. This occurs at the end of the working stroke.

One object of the retard device 6, 19 is to absorb the kinetic energy which may remain in the piston unit 2 after that the intended work has been performed. The main purpose of the retard device is, however, to absorb the entire amount of kinetic energy at no-load strokes. For that purpose it contains a liquid which generates a retarding force upon the retard piston 18 as the latter enters the cup-shaped portion 19 and presses out the liquid therefrom through the narrow clearance. The cup-shaped portion 19 may very well be slightly conical so that the width of the clearance decreases as the retard piston gets deeper into this portion. Thereby, a successively increased retarding force is obtained. For avoiding pressure to be built up in the retard chamber 6, the latter is connected to the atmosphere through a ventilating channel 20.

In its rear end wall, the drive chamber 3 is provided with an inlet opening 21 for pressure air. The drive chamber is also provided with outlet ports 22 which are so located as to be in front of the drive piston 7 as the latter is in its rear end position and to be behind the drive piston as the latter is in its forward end position. This means that an air cushion is enclosed in the forward part of the drive chamber 3 as the drive piston has passed the outlet openings 22 during the working stroke.

The inlet opening 21 interconnect the drive chamber 3 and the charge chamber 4. This connection is broken as the drive piston 7 is in its rear end position in that a sealing portion 23, constituted by a rear extension of the drive piston 7, enters the inlet opening 21 and seals it off.

The charge chamber 4 is fed with pressure air from the pressure air source through a conduit 25 which is continuously connected to the pressure air source an inlet channel 24 and an inlet valve 26. The latter is located in the rear end wall of the charge chamber 4. The inlet valve 26 is constituted by a chamber 27 through which the rear end of the piston rod 7 extends. For letting the piston rod through, the chamber 27 is provided with two oppositely located openings the forward one of which registers with a waist 28 of the piston rod as the latter is in its rear end position.

The operation order of the impact device is the following.

Figure 1:
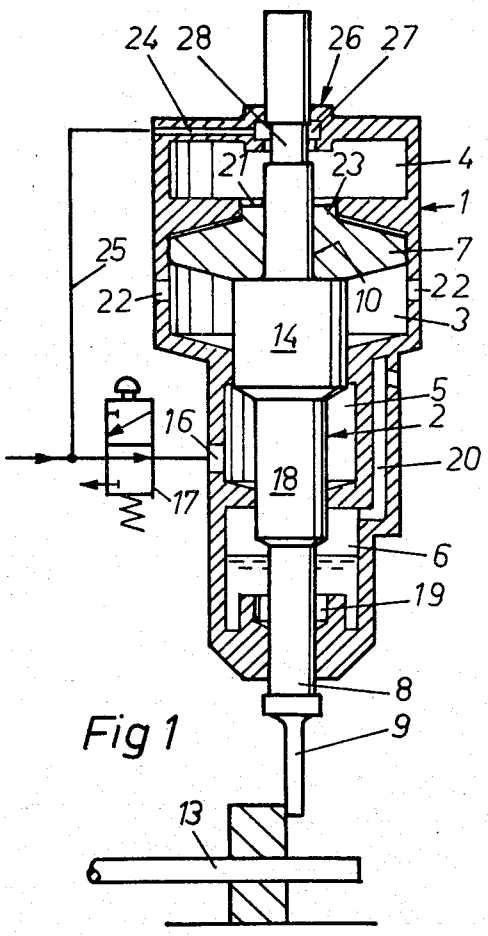

As the conduit 25 and the valve 17 is connected to the air source, the piston unit 2 is in its rest position, e.g. its rear end position (see FIG. 1). This is accomplished provided that the valve 17 is in its rest position too. In this position the reverse chamber 5 as well as the charge chamber 4 is connected to the pressure air source. This is due to the position of valve 17 and the position of the waist 28 of the piston rod 8, the latter of which registers with the forward opening in the valve chamber 27. A full pressure is now built up in the charge chamber 4.

In this position, the piston unit is acted upon by two counter directed forces one of which is backwardly directed as a result of the pressure air action on the reverse piston 14 and one forwardly directed force generated by the pressure air acting upon the sealing portion 23 of the drive piston 7. Owing to the fact that the active area of the reverse piston 14 is larger than that of the sealing portion 23, a resultant backwardly directed force is accomplished. This resultant force biases the piston unit 2 backwardly, toward the rest position of the latter and exceeds, for instance, the weight of the piston unit. In this rest position, the drive piston 7 as well as the reverse piston 14 and the retard piston 18 are in their rear end positions and the driving surface 12 of the drive piston 7 is in contact with the shoulder 11 of the piston rod 8.

This rest position is stable and is maintained until the valve 17 is shifted. As the valve 17 is shifted the connection between the reverse chamber 5 and the pressure air source is broken. Instead, the reverse chamber is connected to the atmosphere and thereby released from pressure. As the force acting on the reverse piston 14 has decreased to a certain extent, the forward directed force acting upon the sealing drive piston extension drives the piston unit 2 forwardly, downwardly. When the piston unit 2 has moved some small distance forwardly, the sealing engagement between the sealing portion 23 and the edge of the inlet opening 21 is broken so that pressure air may enter the drive chamber 3 and get access to the entire active area of the drive piston 7. The result of that is a sudden multiplication of the driving force and as the reverse chamber 5 is released from pressure, the piston unit 2 is accelerated forwardly without any resistance.

By cooperation between the driving surface 12 and the shoulder 11, the drive piston 7 drives the piston rod 8 and the tool 9 forwards toward the billet 13 to be worked. During the first part of the working stroke, the air which is situated in the drive chamber 3 in front of the drive piston 7 leaves the drive chamber through the outlet openings 22. In a later sequence of the working stroke, the drive piston 7 passes the outlet opening 22 and encloses an air cushion in the front part of the drive chamber 3. At further movement of the piston unit 2, the enclosed air cushion is compressed, whereby a retarding force is generated upon the drive piston 7. Thereby, the latter is retarded and stopped.

As the piston rod 8 is freely displaceable forwards relative to the drive piston 7, it is not influenced by the drive piston retardation but continues forwardly to perform the intended work. The billet 13 to be worked is located so that the drive piston 7 has been retarded before it is hit by the tool 9.

As the billet has been hit by the tool 9 and as the piston rod 8 has moved a small distance further, the retard piston 18 enters the cup-shaped portion 19 of the retard chamber 6. The liquid in front of the retard piston 18 is then pressed out of the portion 19 through the narrow clearance between the inner wall of the portion 19 and the retard piston 18. Hereby, a retarding force is generated upon the retard piston 18 and the piston rod 8.

Almost at the same time as the seal between the charge chamber 4 and the drive chamber 3 was broken at the beginning of the working stroke, the connection between the charge chamber 4 and the pressure air source was broken too. This was accomplished in that the waist 28 of the piston rod 8 got out of alignment with the forward opening of the valve chamber 27. This connection had to be broken by two reasons. One of these is that pressure air otherwise would act upon the entire area of the drive piston 7 during the succeeding return stroke which would result in that the piston unit 2 could not be returned by the return piston 14 as the latter has a considerably smaller area than the drive piston 7. The other reason is that pressure air would flow straight through the cylinder housing 1, in through the valve 26 and out through the outlet openings 22 as the drive piston 7 is in its forward end position. This would result in an undesirable loss of pressure air.

When a working stroke is completed, the valve 17 is shifted toward the position shown in FIG. 3 (its rest position) which means that the reverse chamber 5 is connected to the pressure air source. As pressure air enters the reverse chamber 5, a backwardly directed force starts to act upon the reverse piston 14 and the piston rod 8 as well as the drive piston 7 are driven backwardly toward their rear end positions. Just before the piston unit 2 reaches its rear end position, the communication between the charge chamber 4 and the drive chamber 3 is broken in that the sealing portion 23 of the drive piston 7 seals off the opening 21. Almost at the same time, the waist of the piston rod 8 register with the forward opening of the chamber 27, whereby the charge chamber 4 is connected to the pressure air source. A pressure is built up within the charge chamber 4 and the impact device is ready for performing another working stroke.

For avoiding an air cushion to be enclosed in the rear part of the drive chamber during the return stroke, the drive chamber is provided with one or more ventilating openings of small diameter (not shown). However, these openings must be of such a size that they will not influence upon the driving pressure during the working stroke.

In order to avoid a working stroke to be initiated before a full pressure has been obtained in the charge chamber 4, the impact device may be provided with a pressure sensitive valve (not shown). Such a valve should be responsive to the pressure in the charge chamber and automatically make sure that the reverse chamber 5 is not released from pressure until a full pressure has been obtained in the charge chamber.

In an impact device according to the invention the drive piston is completely protected from any heavy strains. This is obtained by making the piston rod 8 and the drive piston freely displaceable relative to each other. The kinetic energy of the piston rod 8 is not transferable to the drive piston 7 at the end of the working stroke which is very essential, especially at no-load strokes. This arrangement makes it possible to use a drive piston of a considerably larger diameter than what has been possible before. It is also possible to make the drive piston of a lighter and less strength resistant material like plastics or wood. It is even possible to decrease the entire mass of the piston unit though the drive piston 7 has a larger diameter.

By the piston arrangement according to the invention, it is possible to shorten the working stroke length of an impact device and yet maintain the velocity at the end of the working stroke. This makes it possible to use a simpler and cheaper punching or high velocity cropping tool.

The invention is not limited to the shown and described embodiment but can be freely varied within the scope of the claims.

I claim:

1. A pneumatic impact device comprising:

a cylinder housing (1) having a front end wall;

a drive chamber (3) in said cylinder housing (1);

inlet (21) and outlet (22) openings in said drive chamber (3) for motive pressure air;

a drive piston (7) provided with a large driving area, said drive piston (7) being reciprocably guided within said drive chamber (3);

a piston rod (8) adapted to carry and apply impacts via a working implement (9);

power-transmitting abutting means (12) on respectively said drive piston (7) and said piston rod (8) for transferring a driving force from said drive piston (7) to said piston rod (8) during a working stroke of said drive piston (7) so as to cause said piston rod (8) to deliver impact energy against an object when in an impact position;

said piston rod (8) being freely displaceable over a given range relative to said drive piston (7) towards said impact position; and said pressure air outlet opening (22) of said drive chamber (3) being located so as to be covered by said drive piston (7) during the last part of the working stroke thereof to define a closed air cushion maintaining means between said drive piston (7) and the front end wall of said drive chamber for retarding movement of said drive piston (7) and thereby disengaging said abutting means before said piston rod (8) reaches said impact position.

2. Impact device according to claim 1, comprising a central bore (10) formed in said drive piston (7), said piston rod (8) extending through said central bore; and a shoulder on said piston rod (8) facing backwards relative to said front end wall of said housing, said shoulder forming said abutting means on said piston rod (8).

3. Impact device according to claim 1, comprising a reverse piston (14) which includes an annular shoulder (14) on said piston rod (8); and said cylinder housing (1) includes a pressure air chamber (5) surrounding said reverse piston, said reverse piston (14) being adapted to return said piston rod (8) as well as said drive piston (7) back to their working stroke starting positions after a completed working stroke.

4. Impact device according to claim 3, wherein said cylinder housing (1) includes: a charge chamber (4) for accumulating pressure fluid; and a fluid communication means (21) between said charge chamber (4) and said drive chamber (3), said pressure fluid producing the driving force acting on said drive piston (7) when admitted to said drive chamber (3); and said drive piston (7) includes a sealing piston-like portion (23) thereon which is arranged to close said fluid communication means (21) when said drive piston (7) is in said working stroke starting position.

5. Impact device according to claim 4 wherein the area of said sealing piston-like portion exposed to said pressure fluid is less than the area of said annular shoulder of said reverse piston (14) exposed to pressure air in said pressure air chamber (5).

6. Impact device according to claim 1, wherein said drive piston (7) is made of a light-weight material.

7. Impact device according to claim 6, wherein said material is a plastic material.

8. Impact device according to claim 6, wherein said material is wood.

9. Impact device according to claim 1, wherein said cylinder housing (1) includes a retard means (6,19) for limiting the length of movement of said piston rod (8) at the end of the working stroke thereof.

10. Impact device according to claim 9, wherein said retard means comprises a retard chamber (6) in said cylinder housing and containing a liquid; a retard piston (18) comprised of an annular shoulder on said piston rod (8); a cup-shaped portion (19) in said retard chamber (6); said retard piston (18) being adapted to enter said cup-shaped portion (19) during the end of the working stroke of said piston rod (8), said cup-shaped portion (19) being dimensioned so as to provide a narrowed clearance between the walls thereof and said retard piston (18) when said retard piston (18) enters said cup-shaped portion (19).

11. Impact device according to claim 1, wherein said cylinder housing (1) includes pressure fluid accumulating means in fluid communication with said drive chamber (3) for producing driving forces on said drive piston (7) which result in impact forces on said piston rod (8).

12. In a method of imparting a rapid acceleration and a subsequent quick retardation to a drive piston in an impact device of the type wherein a drive piston provided with a large driving area is reciprocably guided within a drive chamber in a cylinder housing, and an impact piston is longitudinally displaceable relative to said drive piston and is adapted to carry a working implement to deliver impact energy against an object, the improvement comprising:

depressurizing a reversing chamber in said cylinder housing;

charging only a first surface area portion of said drive piston with pressure fluid to cause said drive piston to move relatively slowly in the driving direction;

thereafter suddenly charging a surface area portion of said drive piston which is larger than said first surface area portion with pressure fluid after said drive piston has moved a short distance to suddenly provide a large driving force on said drive piston to cause said drive piston to rapidly accelerate;

transferring said driving force from said drive piston to said impact piston; and retarding the movement of said drive piston before said impact piston reaches a position where it delivers its impact, whereat a working implement hits said object, thereby preventing said drive piston from being exposed to recoil stresses occurring in said impact piston.

13. Method according to claim 12, comprising hydraulically retarding movement of said impact piston after having delivered impact energy to said impact piston.

14. Method according to claim 12, comprising making said impact piston and said drive piston freely displaceable relative to each other over a given range of movement.

* * * * *